US009321273B2

(12) United States Patent
Saikawa

(10) Patent No.: US 9,321,273 B2
(45) Date of Patent: Apr. 26, 2016

(54) LIQUID DISCHARGE HEAD

(71) Applicant: CANON KABUSHIKI KAISHA, Tokyo (JP)

(72) Inventor: Hideo Saikawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/541,009

(22) Filed: Nov. 13, 2014

(65) Prior Publication Data

US 2015/0138277 A1 May 21, 2015

(30) Foreign Application Priority Data

Nov. 15, 2013 (JP) ..... 2013-236738

(51) Int. Cl.
*B41J 2/14* (2006.01)
*B41J 2/175* (2006.01)
*B41J 29/02* (2006.01)

(52) U.S. Cl.
CPC ..... *B41J 2/17523* (2013.01); *B41J 2/175* (2013.01); *B41J 2/17513* (2013.01); *B41J 2/17553* (2013.01); *B41J 29/02* (2013.01); *B41J 2002/14362* (2013.01)

(58) Field of Classification Search
CPC ..... G06F 3/0641; G06F 3/0608; G06F 3/067; B41J 2/1631; B41J 2/1628; B41J 2/175; B41J 2/17513; B41J 2/17553; B41J 29/02; B41J 2002/14362; B41J 2/17523
See application file for complete search history.

(56) References Cited

U.S. PATENT DOCUMENTS

2010/0134571 A1* 6/2010 Shimizu ..... 347/85
2011/0242235 A1* 10/2011 Kitamura ..... 347/89
2011/0316942 A1* 12/2011 Koyama ..... 347/85
2012/0044284 A1* 2/2012 Katoh ..... B41J 2/175 347/6

FOREIGN PATENT DOCUMENTS

JP 2002-019146 A 1/2002

* cited by examiner

*Primary Examiner* — Julian Huffman
*Assistant Examiner* — Jeremy Delozier
(74) *Attorney, Agent, or Firm* — Canon USA Inc. IP Division

(57) ABSTRACT

A liquid discharge head including:
a liquid discharge member provided with a first supply channel and configured to discharge liquid;
a liquid supply member provided with a second supply channel for supplying the liquid to the first supply channel; and
a resilient member having a through hole for connecting the first supply channel and the second supply channel and provided between the liquid discharge member and the liquid supply member in contact with the liquid discharge member and the liquid supply member,
wherein the resilient member includes a beam portion configured to couple walls that define the through hole.

12 Claims, 7 Drawing Sheets

LIQUID DISCHARGE HEAD

BACKGROUND OF THE INVENTION

1. Field of the Invention

This disclosure relates to a liquid discharge head configured to discharge liquid.

2. Description of the Related Art

In the related art, an inkjet recording head (hereinafter, referred to also as a recording head) as a liquid discharge head is configured to introduce inks in a plurality of colors introduced from ink tanks or the like into an ink discharge unit via supply channels formed in an interior of the recording head.

Japanese Patent Laid-Open No. 2002-019146 discloses a recording head configured to introduce ink via a joint seal member (resilient member) formed of a resilient material provided between a tank holder unit (hereinafter, referred to also as a holder unit) and an ink discharge unit (hereinafter, referred to also as a discharge unit). FIG. 1 is an exploded perspective view of a recording head of the related art. FIGS. 2A and 2B are schematic drawings illustrating a cross section of part of the recording head. FIG. 2A illustrates a state in which assembly of the recording head is completed.

A holder unit H10 is a member to which an ink tank is mounted, and is provided with an ink inlet portion to be connected to the ink tank via a filter. The holder unit H10 includes an ink supply channel H11 formed in an interior thereof, and one end of the ink supply channel H11 has a configuration being formed in an interior of a projection H12 projecting toward a discharge unit H20.

The discharge unit H20 is a member configured to discharge ink, and the discharge unit H20 includes an ink supply channel H23 formed corresponding to the ink supply channel H11 of the holder unit H10.

A joint seal member H30 is arranged between the holder unit H10 and the discharge unit H20, and the joint seal member H30 is provided with a through hole H31 for connecting the ink supply channel H11 and the ink supply channel H23 formed therethrough.

Lip portions H32 for enhancing hermeticity when being pressed by the holder unit H10 and the discharge unit H20 are provided around openings on both ends of the through hole H31 of the joint seal member H30. The joint seal member H30 being interposed between the holder unit H10 and the discharge unit H20 and being pressed thereby secures a sealing property between the holder unit H10 and the discharge unit H20. With the provision of the joint seal member H30, a connection between the holder unit H10 and the discharge unit H20 is achieved without using an adhesive agent, and hence selection of the adhesive agent considering anti-ink properties is not necessary and, in addition, an assembly step of the recording head may be simplified.

In a process of manufacturing the recording head includes a step of inspecting a discharging performance of the recording head by discharging ink before shipping. In a state in which the ink in the inspection step remains in the supply channel, the ink is cured before a user receives the recording head, and hence the performance of the recording head may disadvantageously be impaired. Accordingly, a step of removing the ink in the supply channel is performed after the inspection step.

In order to remove the ink, an interior of the supply channel is cleaned by a washing liquid, and then compressed hot air is fed into the supply channel from the ink inlet portion for drying up the washing liquid. FIG. 2B is a schematic drawing of part of the cross section of the recording head, and illustrates a state in which compressed air is fed from the ink inlet portion for washing the interior of the supply channel and drying up the washing liquid.

Here, if the interior of the supply channel assumes a compressed state when washing and drying up the interior of the supply channel, the joint seal member H30 may be deformed in a direction indicated by an arrow K, and may not restore its original shape even after air feed is stopped. In this case, the lip portions H32 may be displaced and cannot maintain the hermeticity and, consequently, washing or drying may not be performed sufficiently. In such a case, a space may be formed by depression inward of the supply channel due to a deformation of the lip portions H32 and the washing liquid may remain in the space. The remaining washing liquid may be increased in viscosity and anchored, and consequently impair a discharge of the ink as a foreign substance during distribution (during a period until the user receives the recording head). In addition, when the degree of deformation is significant, the hermeticity in the ink supply channel cannot be maintained, and hence a leakage of ink may occur. In contrast, if an air pressure at the time of drying is lowered, a period required for drying the interior of the supply channel is increased, and hence lowering of productivity of the recording head results.

SUMMARY OF THE INVENTION

A liquid discharge head of this disclosure includes:

a liquid discharge member provided with a first supply channel and configured to discharge liquid;

a liquid supply member provided with a second supply channel for supplying the liquid to the first supply channel; and a resilient member having a through hole for connecting the first supply channel and the second supply channel and provided between the liquid discharge member and the liquid supply member in contact with the liquid discharge member and the liquid supply member, wherein the resilient member includes a beam portion configured to couple walls that define the through hole.

Further features of the present invention will become apparent from the following description of exemplary embodiments with reference to the attached drawings.

DESCRIPTION OF THE EMBODIMENTS

First Embodiment

Figure 3:
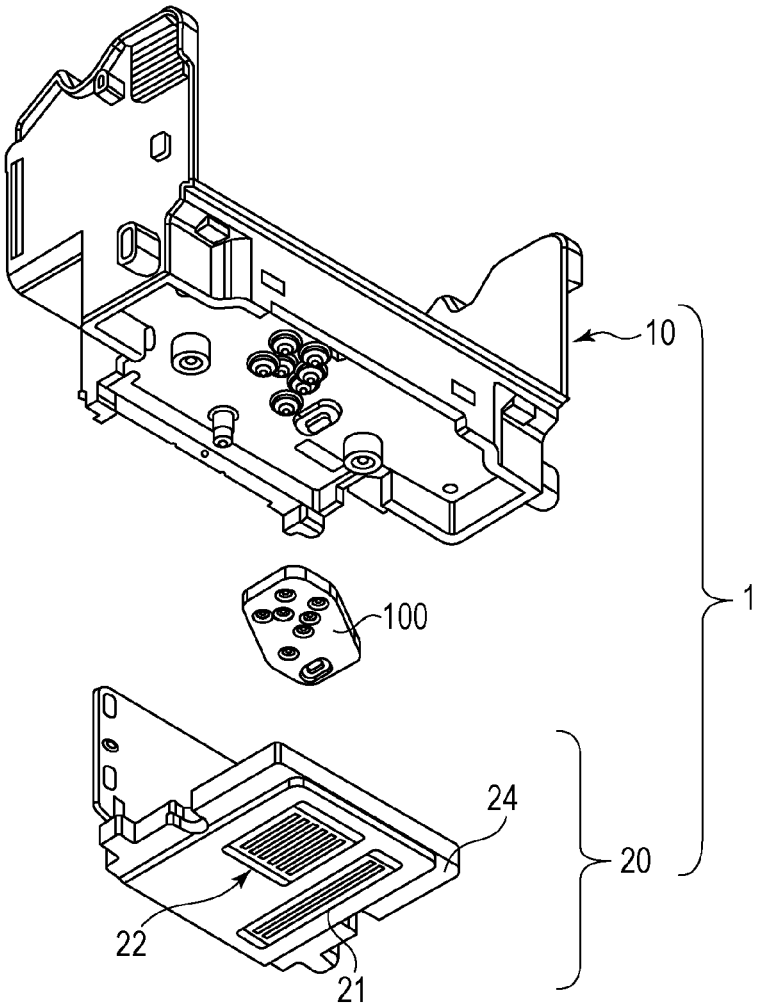
FIG. 3 is an exploded perspective view of a recording head of a first embodiment.

FIG. 3 is an exploded perspective view of a recording head 1 as a liquid discharge head of a first embodiment.

The recording head 1 includes a holder unit 10 as a liquid supply member to which an ink tank is mounted, a discharge unit 20 as a liquid discharge member configured to discharge ink, and a joint seal member 100 as a resilient member for connecting an ink supply channel therebetween. The discharge unit 20 includes discharge substrates 21 and 22 configured to discharge ink and a supporting member 24 configured to support the discharge substrates 21 and 22.

Figure 4:
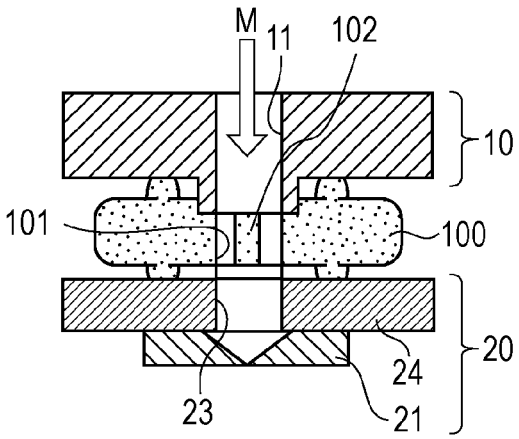
FIG. 4 is a cross-sectional schematic drawing illustrating part of the recording head of the first embodiment.

FIG. 4 is a cross-sectional schematic drawing illustrating part of the ink supply channel of the recording head 1 illustrated in FIG. 3.

The ink supplied from the ink tank passes through an ink supply channel 11 (second supply channel) of the holder unit 10, a through hole 101 of the joint seal member 100, and an ink supply channel 23 (first supply channel) of the supporting member 24 in this order and is supplied to the discharge substrate 21. The supplied ink is discharged from the discharge substrate 21 to a recording medium, and recording is performed.

Here, the holder unit 10 is formed of a resin material having a relatively high rigidity, the supporting member 24 is formed of a material having a high rigidity such as ceramic, and the joint seal member 100 is formed of a material having resiliency formed of elastomer.

The through hole 101 of the joint seal member 100 connects the ink supply channel 11 of the holder unit 10 and the ink supply channel 23 of the discharge unit 20. When the recording head 1 is assembled, the joint seal member 100 comes into contact with the holder unit 10 and the discharge unit 20, and is pressed and collapsed thereby, so that the ink supply channel is sealed.

In general, as regards an ink color being discharged from a large number of discharge ports or an ink color being discharged by a large amount, the amount of flow of ink to be supplied is large correspondingly. Therefore, it is desirable to increase the cross-sectional area of the ink supply channel. In the first embodiment, the length of a discharge port row of the discharge substrate 21 which discharges black ink is longer than the length of a discharge port row of the discharge substrate 22 which discharges color ink. The cross-sectional area of the ink supply channel connected to the discharge substrate 21 is larger than that of the ink supply channel connected to the discharge substrate 22. Specifically, the cross section of the ink supply channel connected to the discharge substrate 21 has an elongated hole shape to secure a sufficient flow amount, and the cross section of the ink supply channel connected to the discharge substrate 22 has a circular shape.

Subsequently, part of the process of manufacturing the recording head 1 will be described.

The recording head 1 is assembled by pressing the joint seal member 100 by the holder unit 10 and the discharge unit 20 and screwing or adhering these two units while maintaining the compressed state of the joint seal member 100. Also, electric connecting components required for recording action is assembled for manufacture. After the manufacture, ink is introduced into the recording head 1 in order to inspect a discharging performance of the recording head 1, and the ink is discharged to perform a printing inspection.

In a state in which the ink in the inspection step remains in the supply channel, the ink is anchored before a user receives the recording head, and hence the performance of the recording head may disadvantageously be impaired. Accordingly, a step of removing the ink in the interior of the supply channel is performed after the inspection step.

Here, washing liquid such as pure water is flowed in the ink supply channel 11 from a direction indicated by an arrow M in FIG. 4, so that the ink in the recording head 1 is replaced by the pure water. Subsequently, the pure water in the recording head 1 is drained by blowing pressurized hot air from the direction indicated by the arrow M for a certain period to dry the ink supply channel. Liquid other than the pure water may be used as the washing liquid, and colorless ink or the like which is obtained by removing pigment component of dye or colorant from ink may be used.

Figure 5A:
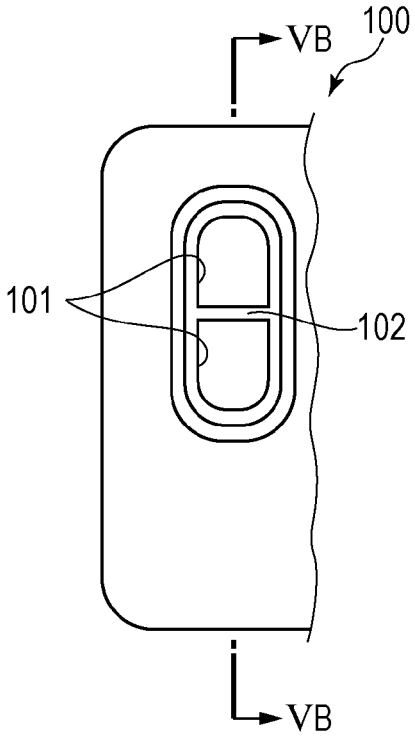
FIGS. 5A and 5B are a plan view and a cross-sectional view of a joint seal member of the recording head of the first embodiment.
Figure 5B:
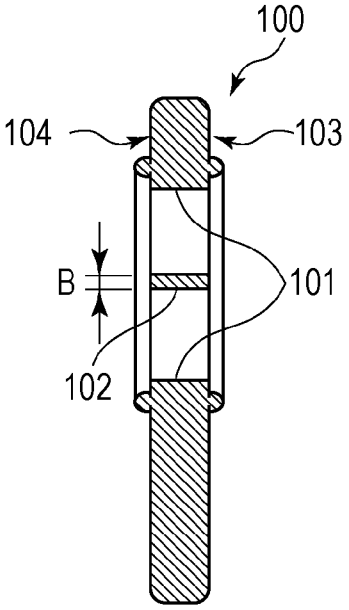

FIGS. 5A and 5B illustrate the joint seal member 100 of the first embodiment. FIG. 5A is a partial plan view of the joint seal member 100, and FIG. 5B is a schematic cross sectional view taken along the line VB-VB in FIG. 5A.

In the first embodiment, a beam portion 102 formed integrally with the joint seal member 100 and coupling walls that define the through hole 101 is provided at a center portion of the elongated shaped through hole 101 as illustrated in FIG. 5A. As illustrated in FIG. 5B, the beam portion 102 extends from the side of a surface 103 of the joint seal member 100 facing the discharge unit 20 to the side of a surface 104 of the joint seal member 100 facing the holder unit 10. In the first embodiment, the joint seal member 100 is formed of chlorinated butyl rubber, and a widthwise dimension B of the beam portion 102 is approximately 0.8 mm.

As described above, since the interior of the supply channel becomes a pressurized state at the time of washing and drying of the ink supply channel, a deformation of the joint seal member 100 may occur. However, in the first embodiment, since the beam portion 102 is provided on the joint seal member 100, the deformation of the joint seal member 100 is restrained, and a sealing property between the holder unit 10 and the discharge unit 20 can be secured. As illustrated in FIG. 5B, projecting portions are formed around the through hole 101 of the joint seal. These projecting portions are formed on both surfaces of the joint seal, and project from the beam portion. In this configuration, a deformation of the through hole can be restrained by the beam portion while securing adhesiveness between the holder unit 10 and the discharge unit 20 with the projecting portions.

Figure 6:
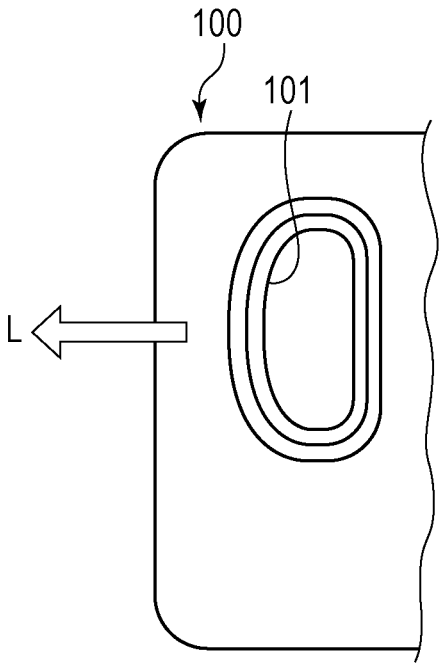
FIG. 6 is a drawing for explaining a deformation of the joint seal member provided with an elongated through hole.

FIG. 6 is a partial plan view of the joint seal member 100 which is not provided with the beam portion 102 as a comparative example. If the beam portion 102 is not provided on the joint seal member 100 provided with the elongated through hole 101, a force applied to the wall which defines a long side of the through hole 101 at a right angle is larger than a force applied to the other wall, so that an edge portion which constitutes the long side is susceptible to deformation in a direction indicated by an arrow L. Therefore, in the first embodiment, the beam portion 102 is provided so as to couple the walls which define the long sides of the elongated hole shape. In other words, the beam portion 102 is provided so as to couple the walls along a direction intersecting a longitudinal direction of the through hole 101. Accordingly, the walls which define the long sides are restrained from moving away from each other, and the deformation of the joint seal member 100 can be restrained.

In this manner, it is preferable to provide the beam portion 102 specifically at portions which are susceptible to deformation. In the first embodiment, the elongated shaped through hole 101 has been described. However, the shape of the through hole 101 is not limited thereto, and the direction of the beam portion 102 is not limited to the configuration described above.

Second Embodiment

Figure 7:
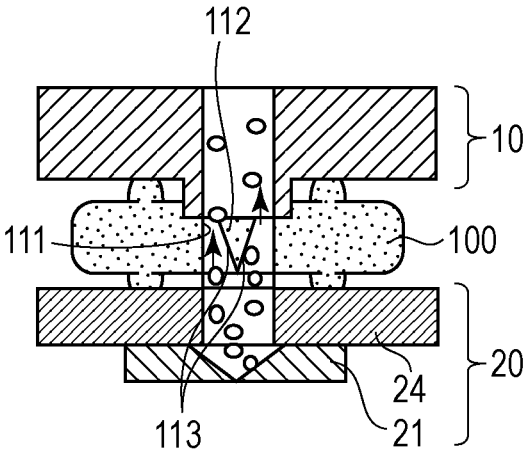
FIG. 7 is a cross-sectional schematic drawing illustrating part of the recording head of a second embodiment.

FIG. 7 is a cross-sectional schematic drawing illustrating part of an ink supply channel of the recording head 1 of a second embodiment, and is a drawing for explaining a behavior of bubbles generating at the time of recording.

FIG. 7 is a drawing of the recording head illustrating a posture at the time in use, and the holder unit 10 side is positioned on the upper side and the discharge unit 20 is positioned on the lower side at the time in use. Part of bubbles generating in association with discharge of ink of the recording head 1 may move upward. However, if there is a flat portion such as a ceiling, the bubbles tend to be accumulated at that portion, and the bubbles grow gradually and clog the ink supply channel, so that the supply of ink is impaired and the discharge may be affected.

Accordingly, in the second embodiment, a surface of a beam portion 112 on the side facing the discharge unit 20 of the beam portion 112 provided in a through hole 111 of a joint seal member 110 is a tapered inclined surface 113. Accordingly, the flat portion is reduced, and hence the accumulation of the bubbles can be restrained.

In the second embodiment, the inclined surface 113 is employed. However, any shape may be employed as long as the bubbles may be accumulated, and shapes which encourage the bubbles to move upward such as an arc shape may be employed.

Third Embodiment

Figure 8:
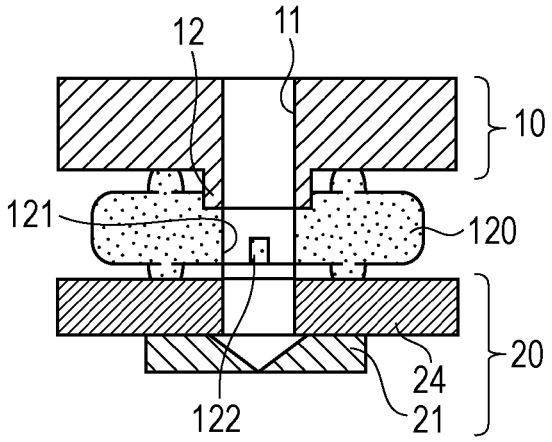
FIG. 8 is a cross-sectional schematic drawing illustrating part of the recording head of a third embodiment.

FIG. 8 is a cross-sectional schematic drawing illustrating part of the ink supply channel of the recording head 1 of a third embodiment disclosed here.

As illustrated in FIG. 8, part of the ink supply channel 11 of the holder unit 10 is formed on a projection 12 projecting toward a joint seal member 120, and the projection 12 is inserted into the interior of a through hole 121 of the joint seal member 120. In contrast, if the supporting member 24 of the discharge unit 20 is formed of, for example ceramic, it is difficult to provide the projection. Therefore, the supporting member 24 is formed into a flat shape so as to restrain leakage of the ink by pressing the joint seal member 120 in cooperation with the holder unit 10.

Figure 1:
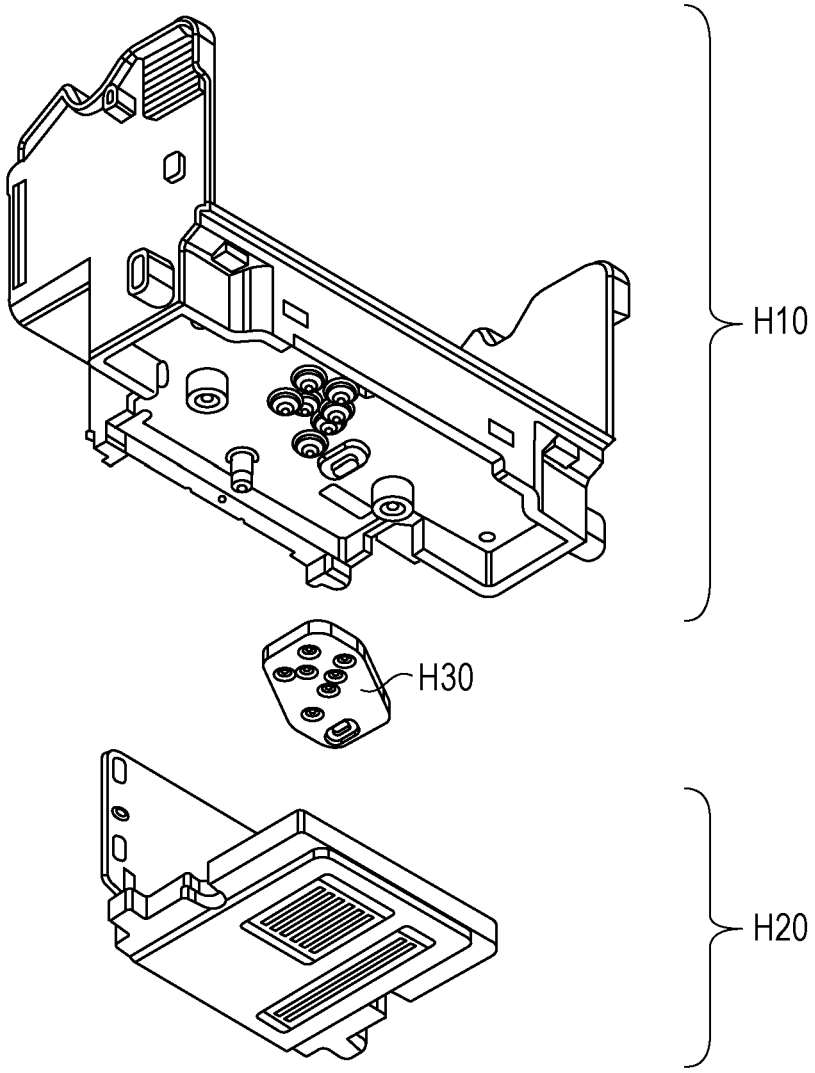
FIG. 1 is an exploded perspective view of a recording head of the related art.
Figure 2A:
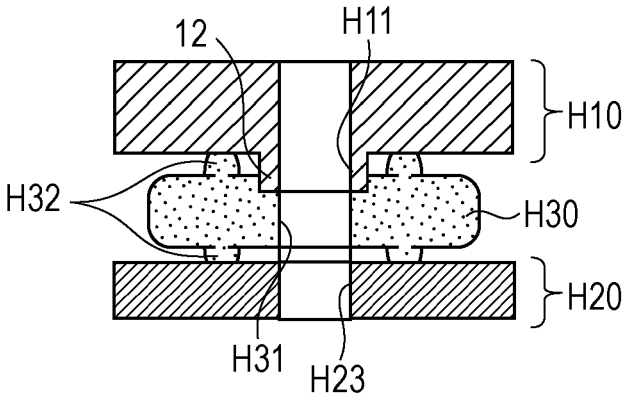
FIGS. 2A and 2B are cross-sectional schematic drawings illustrating part of the recording head of the related art.
Figure 2B:
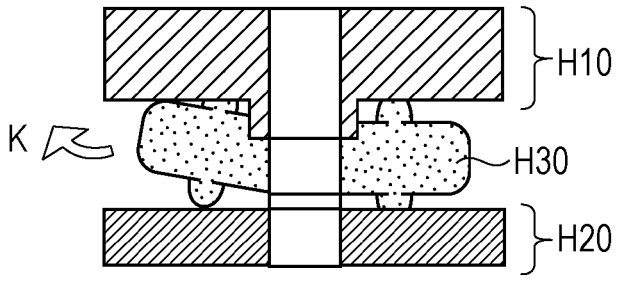

Therefore, as illustrated in FIG. 2A, the joint seal member 120 is susceptible to deformation more on the discharge unit 20 side than the holder unit 10 side at the time of washing and drying of the ink supply channel.

Accordingly, the joint seal member 120 illustrated in FIG. 8 includes a beam portion 122 provided in the through hole 121 at a position closer to the discharge unit 20 than the holder unit 10 provided with the projection 12. Accordingly, the volume of the beam portion 122 can be restrained while restraining the deformation on the side of the discharge unit 20 which is more susceptible to deformation.

Fourth Embodiment

Figure 9:
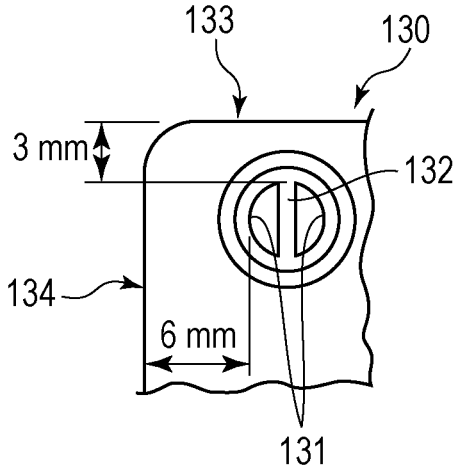
FIG. 9 is a plan view illustrating part of a joint seal member of the recording head of a fourth embodiment.

FIG. 9 is a plan view of a joint seal member 130 of the recording head 1 of a fourth embodiment.

The joint seal member 130 is provided with a circular shaped through hole 131 at a distance of 3 mm from an outer edge portion 133 of the joint seal member 130 and a distance of 6 mm from an outer edge portion 134 of the joint seal member 130.

Here, in the case where a beam portion 132 is not provided in the through hole 131, the joint seal member 130 is susceptible to deformation at a portion relatively shorter in distance between the through hole 131 and the outer edge portion of the joint seal member 130 at the time of washing and drying the ink supply channel. In other words, in the fourth embodiment, the through hole 131 is susceptible to deformation more toward the outer edge portion 133 than toward the outer edge portion 134.

Therefore, in the fourth embodiment, in order to restrain the deformation toward the outer edge portion 133, the beam portion 132 is provided along a direction of the distance between the outer edge portion 133 and the through hole 131 so as to couple walls of the through hole 131. Accordingly, the volume of the beam portion 132 can be restrained while restraining the deformation of the joint seal member 130.

Fifth Embodiment

Figure 10A:
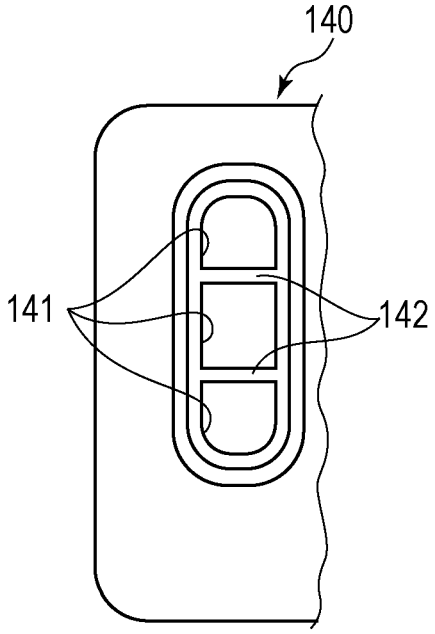
FIGS. 10A and 10B are plan views illustrating part of a joint seal member of the recording head of a fifth embodiment.
Figure 10B:
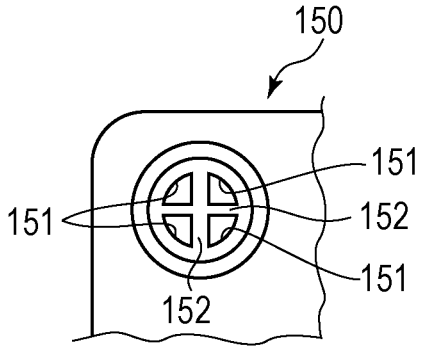

FIGS. 10A and 10B are plan views illustrating part of a joint seal member of the recording head 1 of a fifth embodiment. The fifth embodiment has a configuration in which a plurality of beam portions are provided on the joint seal member.

A through hole 141 of a joint seal member 140 illustrated in FIG. 10A has an elongated shape. Two beam portions 142 are provided as in the fifth embodiment, a deformation of the joint seal member 140 can further be restrained.

Although a through hole 151 of a joint seal member 150 illustrated in FIG. 10B has a circular shape, the diameter is 10 mm, which is relatively large, and is susceptible to deformation of the joint seal member 150. Therefore, two beam portions 152 are provided in a cross shape as in the fifth embodiment, a deformation of the joint seal member 150 can be restrained.

If the beam portion is provided in the through hole, the surface area of the supply channel is reduced, and hence an ink supply property may be disadvantageously lowered. Therefore, the beam portion may be provided as needed depending on the susceptibility of deformation of the joint seal member such as the size or the shape of the through hole.

According to the respective embodiments of this disclosure, since the beam portion is provided in the through hole of the resilient member, a liquid discharge head in which the deformation of the resilient member is restrained, and hermeticity of the supply channel is secured can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-236738, filed Nov. 15, 2013, which is hereby incorporated by reference herein in its entirety.

What is claimed is:

1. A liquid discharge head comprising:

a liquid discharge member provided with a first supply channel and configured to discharge liquid;

a liquid supply member provided with a second supply channel for supplying the liquid to the first supply channel; and a resilient member having a through hole for connecting the first supply channel and the second supply channel and provided between the liquid discharge member and the liquid supply member in contact with the liquid discharge member and the liquid supply member, wherein the resilient member includes:

a first lip portion which is formed around the through hole on one surface of the resilient member, and contacts with the liquid discharge member;

a second lip portion which is formed around the through hole on an opposite surface of the one surface, and contacts with the liquid supply member; and a beam portion configured to couple walls that define the through hole, and wherein the first lip portion, the second lip portion and the beam portion of the resilient member have resiliency.

2. The liquid discharge head according to claim 1, wherein the liquid supply member includes a projection projecting toward the resilient member and entering the through hole, the projection is formed with part of the second supply channel, and the beam portion is provided to a position closer to the liquid discharge member than to the liquid supply member.

3. The liquid discharge head according to claim 1, wherein the through hole has an elongated shape, and the beam portion couples the walls along a direction intersecting a longitudinal direction of the through hole.

4. The liquid discharge head according to claim 1, wherein a surface of the side of the liquid discharge member of the beam portion has a tapered shape or an arcuate shape.

5. The liquid discharge head according to claim 1, wherein the through hole is provided at different distances from a plurality of outer edge portions of the resilient member, and the beam portion couples the walls along a direction connecting the outer edge portion at the relatively shorter distance and the through hole.

6. The liquid discharge head according to claim 1, wherein the through hole is provided with a plurality of the beam portions.

7. The liquid discharge head according to claim 1, wherein the liquid discharge member includes a discharge substrate configured to discharge liquid and a supporting member configured to support the discharge substrate.

8. The liquid discharge head according to claim 1, wherein the resilient member includes a plurality of through holes configured to communicate the liquid supply member and the liquid discharge member, and the beam portion is formed in the through hole having the largest opening surface area from among the plurality of through holes.

9. The liquid discharge head according to claim 1, wherein a projecting portion projecting toward the liquid discharge member is formed around the through hole.

10. The liquid discharge head according to claim 1, wherein a projecting portion projecting toward the liquid supply member is formed around the through hole.

11. The liquid discharge head according to claim 9, wherein the projecting portion projects more than the beam portion in a direction of liquid supply in the through hole.

12. The liquid discharge head according to claim 10, wherein the projecting portion projects more than the beam portion in the direction of liquid supply in the through hole.

* * * * *